US006861612B2

(12) United States Patent
Bolton et al.

(10) Patent No.: US 6,861,612 B2
(45) Date of Patent: Mar. 1, 2005

(54) METHODS FOR USING A LASER BEAM TO APPLY WEAR-REDUCING MATERIAL TO TOOL JOINTS

(76) Inventors: Jimmie Brooks Bolton, 10459 Twin Circles, Montgomery, TX (US) 77356; Billi Marie Rogers, 10211 Cherry Chase Dr., Houston, TX (US) 77042

( * ) Notice: Subject to any disclaimer, the term of this patent is extended or adjusted under 35 U.S.C. 154(b) by 143 days.

(21) Appl. No.: 10/057,549

(22) Filed: Jan. 23, 2002

(65) Prior Publication Data

US 2002/0098298 A1 Jul. 25, 2002

Related U.S. Application Data

(63) Continuation-in-part of application No. 09/769,555, filed on Jan. 25, 2001, now Pat. No. 6,428,858.

(51) Int. Cl.[7] ..... B23K 26/34; B05D 3/06

(52) U.S. Cl. ..... 219/121.64; 219/121.85; 427/596

(58) Field of Search ..... 427/596, 597, 427/554, 555, 556; 219/121.64, 121.85

(56) References Cited

U.S. PATENT DOCUMENTS

| | | | | |
|---|---|---|---|---|
| 3,332,753 A | | 7/1967 | Batchelor et al. | |
| 3,436,248 A | | 4/1969 | Dittrich et al. | |
| 3,579,313 A | | 5/1971 | Pryor et al. | |
| 3,600,790 A | | 8/1971 | Dion et al. | 29/474.1 |
| 3,602,633 A | | 8/1971 | Miller et al. | 174/36 |
| 3,631,586 A | | 1/1972 | Bearpark et al. | 29/474.3 |
| 3,648,356 A | | 3/1972 | Ziemek | 29/474.1 |
| 3,666,879 A | | 5/1972 | Hirsch et al. | 174/128 |
| 3,683,103 A | | 8/1972 | Mancino | 174/119 C |
| 3,777,361 A | | 12/1973 | Fuchs, Jr. | 29/470.6 |
| 3,778,895 A | | 12/1973 | Nomura et al. | 29/599 |
| 3,841,901 A | | 10/1974 | Novinski et al. | 117/105.2 |
| 3,900,695 A | | 8/1975 | Andersson et al. | 13/26 |
| 3,949,466 A | | 4/1976 | O'Brien et al. | 29/628 |
| 4,013,211 A | | 3/1977 | Atman | 228/126 |
| 4,156,123 A | | 5/1979 | Fischer et al. | |
| 4,265,747 A | * | 5/1981 | Copa et al. | |
| 4,284,841 A | | 8/1981 | Tijunelis et al. | 174/103 |
| 4,372,988 A | | 2/1983 | Bahder | 427/52 |
| 4,390,589 A | | 6/1983 | Geyling et al. | 428/381 |
| 4,484,023 A | | 11/1984 | Gindrup | 174/102 |
| 4,515,992 A | | 5/1985 | Gupta | 174/102 |
| 4,542,846 A | | 9/1985 | Matsui et al. | |
| 4,644,127 A | | 2/1987 | Larocca | |
| 4,751,113 A | | 6/1988 | Riccio et al. | 427/404 |
| 5,174,222 A | | 12/1992 | Rogers | 114/222 |
| 5,189,719 A | | 2/1993 | Coleman et al. | 385/101 |
| 5,286,577 A | | 2/1994 | Premkumar et al. | 428/558 |
| 5,294,462 A | | 3/1994 | Kaiser et al. | 427/446 |
| 5,321,228 A | | 6/1994 | Krause et al. | |
| 5,759,641 A | * | 6/1998 | Dimitrienko et al. | |
| 5,945,171 A | | 8/1999 | Cook | 427/456 |
| 5,994,664 A | | 11/1999 | Anderton et al. | |
| 5,997,248 A | * | 12/1999 | Ghasripoor et al. | |
| 6,305,723 B1 | * | 10/2001 | Schutz et al. | |

FOREIGN PATENT DOCUMENTS

| | | |
|---|---|---|
| EP | 035 377 A1 | 9/1981 |
| EP | 035 377 | 9/1981 |
| JP | 02-224 884 A | 9/1990 |
| WO | PCT/US02/01914 | 1/2002 |

* cited by examiner

*Primary Examiner*—Geoffrey S. Evans
(74) *Attorney, Agent, or Firm*—Guy McClung

(57) ABSTRACT

A method for applying wear reducing material to a tool joint useful in a wellbore in drilling operations, the method, in at least certain aspects, including positioning the tool joint adjacent laser beam apparatus, delivering wear-reducing material to a location on the tool joint to which the wear-reducing material is to be applied, heating the wear-reducing material with the laser beam apparatus to a temperature not exceeding its melting temperature so that the wear-reducing material is welded to the tool joint; in one particular aspect, using a defocused laser beam to achieve desired heating temperatures; and, in one aspect, defocusing the laser so no plasma is formed.

22 Claims, 10 Drawing Sheets

Table I

| Al A # | Si | Fe | Cu | Mn | Mg | Cr | Ni | Zn | Ti |
|---|---|---|---|---|---|---|---|---|---|
| 1100 | 1.0 Si + Fe | | 0.20 | 0.05 | --- | --- | --- | 0.10 | --- |
| 2014 | 0.50-1.2 | 1.0 | 3.9-5.0 | 0.40-1.2 | 0.20-0.8 | 0.10 | --- | 0.25 | 0.15 |
| 3004 | 0.30 | 0.7 | 0.25 | 1.0-1.5 | 0.8-1.3 | --- | --- | 0.25 | --- |
| 4032 | 11.0-13.5 | 1.0 | 0.50-1.3 | --- | 0.8-1.3 | 0.10 | 0.50-1.3 | 0.25 | --- |
| 4043 | 4.5-6.0 | 0.8 | 0.30 | 0.05 | 0.05 | --- | --- | 0.10 | 0.20 |
| 5050 | 0.40 | 0.7 | 0.20 | 0.10 | 1.0-1.8 | 0.10 | --- | 0.25 | --- |
| 6063 | 0.20-0.6 | 0.35 | 0.10 | 0.10 | 0.45-0.9 | 0.10 | --- | 0.10 | 0.10 |
| 7075 | 0.50 | 0.7 | 1.2-2.0 | 0.30 | 2.1-2.9 | 0.18-0.40 | --- | 5.1-6.1 | 0.20 |

Fig. 7

Table III

| Common Name | Nominal Chemistry | Trade Name |
|---|---|---|
| Pure Zinc | | |
| AG40A Alloy | 4% Al - 0.04% Mg | Zanak-3 (die casting) |
| AC41A Alloy | 4% Al - 1% Cu - 0.04% Mg | Zamak-5 (die casting) |
| Zinc-base slush-casting alloy | 4.75% Al - 0.25% Cu | |
| Zinc-base slush-casting alloy | 5.5% Al | |
| Commercial rolled zinc | 0.08% Pb | Deep drawing zinc |
| Commercial rolled zinc | 0.06% Pb - 0.06% Cd | |
| Commercial rolled zinc | 0.3% Pb - 0.3% Cd | |
| Copper-hardened rolled zinc | 1% Cu | Zilloy-40 |
| Rolled zinc alloy | 1% Cu 0 0.10% Mg | Zilloy-15 |
| Zn-Cu-Ti alloy | 0.8% Cu - 0.15% Ti | |

Fig. 9

Fig. 8A Table II

| Common Name | Nominal Chemistry | Trade Name |
|---|---|---|
| Electrolytic copper | 99.95 Cu - 0.04 O | Electrolytic tough pitch copper |
| Deoxidized copper, low residual phosphorous (DLP) | 99.92 Cu 0.009 P | --- |
| Deoxidized copper, high residual phosphorous (DHP) | 99.95 Cu 0.02 P | Phosphorized copper; High residual phosphorous |
| Oxygen-Free Copper (OF) | 99.95 Cu | --- |
| Free-Machining Copper | 0.5% Te | Tellurium copper |
| Free-Machining Copper | 1.0 Pb | Leaded copper |
| Silver-Bearing Copper | No. oz / ton X 0.00343 for oz Ag | --- |
| Gilding 95% | 95 Cu - 5 Zn | Gilding metal |
| Commercial bronze 90% | 90 Cu - 10 Zn | --- |
| Jewelry bronze 87.5% | 87.5 Cu - 12.5 Zn | --- |
| Red brass 85% | 85 Cu -15 Zn | --- |
| Low brass 80% | 80 Cu - 20 Zn | --- |
| Cartridge brass 70% | 70 Cu - 30 Zn | Cartridge brass; Spinning brass, Spring brass |
| Yellow brass | 65 Cu - 35 Zn | Drawing brass, Common high brass; Hoop brass |
| Muntz metal | 60 Cu - 40 Zn | --- |
| Leaded commercial bronze | 89 Cu - 9 Zn 1.75 Pb | --- |
| Low-leaded brass (tube) | 66 Cu - 33.5 Zn 0.5 Pb | High brass; Yellow brass |
| Medium-leaded brass | 65 Cu - 34 Zn 1 Pb | Butt brass; Matrix brass; Semi-lead brass; swaging brass |
| High-leaded brass (tube) | 66 Cu - 32.4 Zn 1.6 Pb | Free-cutting tube brass; Leaded high brass |
| High-leaded brass | 65 Cu - 33 Zn 2 Pb | Clock brass; Engraver's brass; Heavy-leaded brass |

**Fig. 8*B*** Table II - Cont'd

| Common Name | Nominal Chemistry | Trade Name |
|---|---|---|
| Extra-high-leaded brass | 63 Cu - 34.5 Zn - 2.5 Pb | --- |
| Free-cutting brass | 61.5 Cu - 35.5 Zn - 3 Pb | Free-turning brass; Free-cutting yellow brass; High-leaded brass |
| Leaded Muntz metal | 60 Cu - 39.4 Zn - 0.6 Pb | --- |
| Forging bronze | 59 Cu - 39 Zn - 2 Pb | --- |
| Architectural bronze | 57 Cu - 40 Zn - 3 Pb | --- |
| Inhibited Admiralty | 71 Cu - 28 Zn - 1 Sn | Admiralty brass |
| Naval brass | 60 Cu - 39.25 Zn 0.75 Sn | --- |
| Leaded naval brass | 60 Cu - 37.5 Zn 1.75 Pb - 0.75 Sn | Leaded naval brass, grade C |
| Manganese bronze | 58.5 Cu - 39 Zn - 1.4 Fe 1 Sn - 0.1 Mn | --- |
| Phosphor bronze, 5%<br>Phosphor bronze, 8%<br>Phosphor bronze, 10%<br>Phosphor bronze, 1.25% | 95 Cu - 5 Sn<br>92 Cu - 8 Sn<br>90 Cu - 10 Sn<br>98.75 Cu - 1.25 Sn | ---<br>---<br>---<br>--- |
| Free-cutting phosphor bronze | 88 Cu - 4 Pb 4 Sn - 4 Zn | 444 bronze; Bearing bronze |
| Cupro-nickel, 30%<br>Cupro-nickel, 10% | 70 Cu - 30 Ni<br>88.7 Cu - 10 Ni - 1.3 Fe | ---<br>--- |
| Nickel-silver, 65-18 | 65 Cu - 18 Ni - 17 Zn | --- |
| Nickel-silver, 55-18 | 55 Cu - 27 Zn - 18 Ni | --- |
| Nickel-silver, 65-12 | 65 Cu - 23 Zn - 12 Ni | --- |
| High-silicon bronze | 96 Cu - 3 Si | Copper-silicon alloy; High-silicon bronze |
| Low-silicon bronze | 97.7 Cu - 1.5 Si | --- |

Fig. 8C Table II - Cont'd

| Common Name | Nominal Chemistry | Trade Name |
|---|---|---|
| Aluminum bronze | 95 Cu - 5 Al | 5% Aluminum bronze |
| Aluminum bronze | 91 Cu - 7 Al - 2 Fe | --- |
| Aluminum bronze | 91 Cu - 9 Al | 9% Aluminum bronze |
| Aluminum bronze | 81.5 Cu - 9.5 Al<br>5 Ni - 2.5 Fe - 1 Mn | --- |
| Aluminum-silicon bronze | 91 Cu - 7 Al - 2 Si | --- |
| Beryllium copper | 97.9 Cu - 1.9 Be -<br>0.2 Ni or Co | Beryllium copper |
| Chromium copper | 1% Cr | --- |
| Tin bronze alloy<br>Tin bronze alloy<br>Tin bronze alloy | 88 Cu - 10 Sn - 2 Zn<br>88 Cu - 8 Sn - 4 Zn<br>89 Cu - 11 Sn | ---<br>---<br>Phosphor gear bronze |
| Navy M bronze alloy | 88 Cu - 6 Sn<br>1 ½ Pb - 4 ½ Zn | Navy M, Stream or Valve bronze |
| Leaded tin bronze | 87 Cu - 8 Sn - 1 Pb - 4 Zn | --- |
| Leaded tin bronze | 87 Cu - 10 Sn - 1 Pb - 2 Zn | --- |
| High-lead tin bronze alloy | 80 Cu - 10 Sn - 10 Pb | Bushing and Bearing bronze |
| High-lead tin bronze alloy | 83 Cu - 7 Sn<br>7 Pb - 3 Zn | --- |
| High-lead tin bronze alloy | 85 Cu - 5 Sn<br>9 Pb - 1 Zn | --- |
| High-lead tin bronze alloy | 78 Cu - 7 Sn - 15 Pb | --- |
| High-lead tin bronze alloy | 70 Cu - 5 Sn - 25 Pb | --- |

**Fig. 8 *D***

Table II - Cont'd

| Common Name | Nominal Chemistry | Trade Name |
|---|---|---|
| Leaded red brass alloy | 85 Cu - 5 Sn<br>5 Pb - 5 Zn | Ounce metal; Composition metal |
| Leaded red brass alloy | 83 Cu - 4 Sn<br>6 Pb - 7 Zn | Hydraulic bronze |
| Leaded semi-red brass | 81 Cu - 3 Sn<br>7 Pb - 9 Zn | Valve metal |
| Leaded semi-red brass alloy | 76 Cu - 2 ½ Sn<br>6 ½ Pb - 15 Zn | Plumbing goods brass |
| Leaded yellow brass alloy | 72 Cu - 1 Sn<br>3 Pb - 24 Zn | High-copper yellow brass |
| Leaded yellow brass alloy | 67 Cu - 1 Sn<br>3 Pb - 29 Zn | No. 1 yellow brass |
| Leaded yellow brass alloy | 61 Cu - 1 Sn<br>1 Pb - 37 Zn | Die cast brass (ingot) |
| Manganese bronze (60,000 psi) | 59 Cu - 0.75 Sn<br>0.75 Pb - 37 Zn<br>1.25 Fe - 0.75 Al - 0.75 Mn | Stem manganese bronze; Leaded high-strength yellow brass |
| Manganese bronze (65,000 psi) | 57.5 Cu - 39.25 Zn<br>1.25 Fe - 1.25 Al - 0.25 Mn | High-strength yellow brass |
| Manganese bronze (90,000 psi) | 64 Cu - 24 Zn<br>3 Fe - 5 Al - 4 Mn | --- |
| Manganese bronze (110,000 psi) | 64 Cu - 26 Zn -<br>3 Fe - 5 Al - 4 Mn | High-strength yellow brass |
| Aluminum bronze alloy | 88 Cu - 3 Fe - 9 Al | --- |
| Aluminum bronze alloy | 89 Cu - 1 Fe - 10 Al | --- |
| Aluminum bronze alloy | 85 Cu - 4 Fe - 11 Al | --- |
| Aluminum bronze alloy | 81 Cu - 4 Fe - 11 Al<br>4 Ni | --- |
| Aluminum bronze | 82 Cu - 4 Fe - 9 Al<br>4 Ni - 1 Mn | Propeller bronze |

**Fig. 8*E***

Table II - Cont'd

| Common Name | Nominal Chemistry | Trade Name |
|---|---|---|
| Nickel Silver (12% Ni) | 57 Cu - 2 Sn - 9 Pb 20 Zn - 12 Ni | Leaded nickel brass; Benedict metal |
| Nickel Silver (16% Ni) | 60 Cu - 3 Sn - 5 Pb 16 Zn - 16 Ni | Leaded nickel brass |
| Nickel Silver (20% Ni) | 64 Cu - 4 Sn - 4 Pb 8 Zn - 20 Ni | Dairy bronze |
| Nickel Silver (25% Ni) | 66.5 Cu - 5 Sn 1.5 Pb - 2 Zn - 25 Ni | Leaded nickel bronze |
| Silicon bronze | 87 Cu - 4 Si - 1 Sn 4 Zn - 2 Fe - 1 Al- 1 Mn | --- |
| Silicon brass | 81 Cu - 4 Si - 15 Zn | --- |

METHODS FOR USING A LASER BEAM TO APPLY WEAR-REDUCING MATERIAL TO TOOL JOINTS

RELATED APPLICATION

This is a continuation-in-part of U.S. Ser. No. 09/769,555 filed Jan. 25, 2001, issued as U.S. Pat. No. 6,428,858 B1 on Aug. 02, 2002 incorporated fully herein for all purposes.

BACKGROUND OF THE INVENTION

1. Field of the Invention

The present invention is directed to improved tool joints used in wellbore operations; such tool joints that have wear-reducing material applied thereto, including, but not limited to hardfacings and carbides; and methods for applying such materials to tool joints.

2. Description of Related Art

"Thermal spraying" refers to a variety of processes for depositing both metallic and non-metallic materials on a substrate to form a coating. Metals, cermets, ceramics, plastics and mixtures thereof in the form of powders, rods or wires may be used as coating material. Heat for melting the material is supplied by electric arc, plasma arc, or combustible fuel gases and compressed air or process gases form an accelerated stream of molten coating material. The material builds up on the substrate and cools to form the coating.

Electric arc spray processes use electrically charged wire which is fed by a wire feeder to an arc spray gun in which the wires converge, arc, and melt in a high temperature zone (e.g. 15,000 degrees F. or higher) created by the arc. A compressed air stream is directed to the arc zone and atomizes the molten material produced from the melting wire. The stream flows from the gun for coating onto a desired substrate.

Molten particle velocities average 100 meters per second; deposit thicknesses average 0.001 to0.003 inches per pass; and deposition rates range between 10 to 40 pounds of material per hour depending on the material and the amperage. By compassing the arc in a gun head relatively little heat is transferred by the molten material to the substrate. Sprayable materials include, but are not limited to, carbon steels, stainless steels, oxides, carbides, nickel alloys, copper, copper alloys, bronze, aluminum, aluminum alloys, zinc, babbitt, and molybdenum. Such materials may be spray to produce a coating or to rebuild a part.

In certain known drilling operations in drilling for oil and gas, a drill string of pipe is used that is secured together by tool joints on which are rings of hardfacing applied for abrasion resistance. Drill collars and a drill bit are connected to the insertion end of the string. A "cased wellbore" is one in which a casing having an inside diameter adequate for passage of the drill string with tool joints, collars and bit is put in place. The rotating action of drilling causes severe wear on the tool joints. One prior art response to this wear problem was oxyacetylene welding of tubular rods filled with tungsten carbide, chromium carbides and/or chromium carbide formers (chromium and carbon) to apply hardbanding to the tool joints. The disadvantages of this method included slow welding speeds and extreme weld heat affected zones.

Tool joints are the connecting members between sections of drill pipe used in a wellbore drilling operation. One member (the box) has an internal thread and the mating member (the pin) has an external thread, by which means they are assembled into a continuous unit with the drill pipe, thus forming a drill string. These tool joints are larger in diameter than the pipes they connect. As drilling proceeds, the tool joints rub against the drilled hole and/or against the drilled hole lining ("casing"). The strength of the connection is engineered around the wall thickness and heat-treated properties of the box above the thread. In the drilling process the wall thickness above the thread thins as it rubs against the formation. The life of the drill pipe is predicated upon the remaining strength of the tool joint. Therefore, thinning of the tool joint material above the thread is undesirable.

One current prior art practice is to weld a cladding on the exterior diameter of the tool joint. The cladding is a material that will resist abrasion caused by the rubbing action against the earthen wall of the hole or the steel casing. In one prior art method tungsten carbide is used in a matrix of steel. As the hole drilling progresses, the procedure is to "case," or insert, a smaller bore steel tube into the hole to drill deeper into the ground. The tungsten carbide wears against the casing and thins the wall, inviting rupture due to external or internal pressure. With this in mind drill pipe users have begun to clad the exterior of the tool joint with materials that are less abrasive to the casing but also less resistant to wear by the earth formation.

The advent of the electric arc in the late 1950's and early 1960's allowed the development of prior art hardfacing for tool joints with electric rods, either solid or tubular, filled with carbides or carbide formers. The Hughes Tool Company and Reed Roller Bit Company developed coatings that would provide good wear results at an economical price. Both companies produced tungsten carbide coatings. Reed Roller Bit Company used Gas Tungsten Arc Welding (GTAW), a process wherein an arc melted the base metal and then carbides were dropped into the molten puddle created by the arc without using external filler metal; the matrix was the tool joint base material. Reed roller Bit Company then developed a Plasma Transferred Arc ("PTA") process. The PTA melted a steel or nickel base powder and deposited tungsten carbide into the molten puddle. The major problem with PTA was consistency of deposit to obtain a uniform bond.

The Hughes Tool Company developed one prior art process that used (the still current) Gas Metal Arc Welding (GMAW), melting a wire as a matrix and depositing carbide into the molten puddle. Both companies used cast-crushed tungsten carbide, which is hard and angular-shaped, but also brittle. The wear pattern of this material often showed the carbides worn flush with the matrix.

Almost simultaneously both companies developed the sintered tungsten carbide pellet. This pellet is a potato-shaped particle of tungsten carbide bound together with a binder of cobalt (see, e.g., U.S. Pat. No. 4,228,339). The wear pattern changed from a smooth, worn surface to one wherein the carbides protruded as the matrix wore away, leaving the more shock-resistant carbides protruding from the surface. U.S. Pat. No. 4,243,727 discloses sintered tungsten carbide granules embedded in an alloy steel matrix. Both the cast tungsten carbide and the sintered tungsten carbide pellets were relatively expensive. In order to trim costs, crushed sintered tungsten carbide made from crushed steel cutting tools was used instead of the pellets; but often the use of this substitute resulted in cut casing.

Another prior art approach was to apply carbides of smaller size. Carbides are measured in openings per inch of a screen. Certain standard carbides are approximately −16+30 mesh material, which will pass through a screen with an opening of 0.046 inches (1.18 mm). It will remain on the surface of a screen with the opening of 0.0234" (0.6 mm). Fine tungsten is −60 mesh (0.009 inches or 0.250 mm) and +80 mesh (0.007 inches or 0.180 mm). The fine tungsten was relatively difficult to apply. Depending upon the exact location at which the welder (operator) introduced the carbide, it either floated on the molten steel pool or was all melted by the arc. Another problem was the density of the carbides. Cast tungsten carbide was heavier and thus more costly by volume. The sintered pellet was difficult to manufacture in this size. It was much lighter in weight and lower in melting point, and it was almost impossible to inject into the molten pool. The crushed sintered material in the fine particle size has sharp points susceptible to melting and alloying.

Quality control and consistency of deposit were also problems. The volume of carbide in these deposits was difficult, if not impossible, to monitor. The systems used to dispense the carbide in many cases were not accurate, and a hardbander could control his cost by simply cutting back on the amount of material he injected into the molten pool. Thus the drilling contractor has had varying results with tool joint hardbanding, particularly since the earth formations vary from location to location.

Another prior art development was the use of chromium bearing materials that are called "casing friendly" because they lower the coefficient of friction between their surface and the surface of the casing (see, e.g., U.S. Pat. No. 5,224,559 issued Jul. 6, 1993). Many of these products are less effective in the protection of a tool joint. In many cases the casing friendly materials were inlayed flush with the diameter of the tool joint, which did not provide maximum protection of a connection. With the casing friendly wires, however, an applicator could not alter or tamper with the alloy content of the wire. In general, the alloy content of the wire dictates its performance in lowering the coefficient of friction and controlling open hole wear of the tool joint. Higher alloy content generally improves both conditions, but often introduces the problem of cracking.

In the prior art a variety of methods have been used to apply wear-reducing material to tool joints: GMAW (gas metal arc welding), GTAW (gas tungsten arc welding), PTA (plasma transferred arc), and FCAW (flux cored arc welding). These welding processes are characterized by establishing an arc between an electrode (either consumable or non-consumable) and tool joint base material. Once this arc is established, intense heat forms a plasma. The gas that forms the plasma is furnished by means of an external gas or an ingredient from a tubular wire. The temperature of the plasma is in excess of 10,000 degrees Kelvin and is highest at the center of the weld, and decreases along the width of the weld. Even at the edge of the weld the temperature often exceeds the melting temperature of the wear-reducing material, e.g., tungsten carbide. Tungsten carbide introduced into a weld puddle (plasma envelope) often melts. The fine tungsten carbide goes into solution. The large carbides decrease in size from the melting of their outer surface. The resulting weld, i.e. tool joint surfacing, often contains only discrete tungsten carbide particles of a large size. These particles can become aggressive grinding elements when they contact steel components, i.e., the weld casing and casing lining a wellbore through which the tool joint will pass. Often attempts to counter the grinding effect, if smaller carbide particles are introduced into the weld, still results in an undesirably high percentage of melted tungsten carbide. Carbides that remain are often spaced-apart at a distance greater than the diameter of the pieces of abrading material (foreign earthen material particles that eat away the matrix that holds the carbides) that cause the carbides to fall out of the matrix affording little wear resistance.

In certain prior art processes as described above, an electric arc penetrates and dilutes the substrate, the material of the tool joint being surfaced. Even using very closely controlled parameters with current prior art processes, it is difficult to achieve a weld with less than 15% dilution. The disadvantage of this dilution is that a chosen material or alloy is diluted and cannot perform to engineered expectations.

There has long been a need for an improved method of application of wear-reducing materials that is effective in applying a range of appropriate materials to tool joints in order to increase service life. There has long been a need for such methods in which: carbides are applied without subjecting them to the intense heat of an electric arc, which dissolves the carbides; a deposit of alloy with minimal additional alloying of the tool joint's base material is deposited; such methods in which intense heat does not alter an alloy's or a material's desired chemistry; such methods in which fine carbides are not melted by intense heat; and such methods that lay down a re-producible hardfacing. There has long been a need for such methods that produce a metallurgical bond between a base material of a tool joint and wear-reducing or hardfacing material applied thereto and such methods which allow the base material of a tool joint to remain unchanged.

SUMMARY OF THE PRESENT INVENTION

In certain embodiments the present invention discloses methods for the laser application of wear-reducing material (e.g., but not limited to, extremely fine carbides) to all or part of a tool joint. In certain methods according to the present invention, wear-reducing materials are applied to a tool joint with heating apparatus so that the melting temperature of the material is not exceeded, thus reducing problems associated with melted materials that go into solution with matrix material that contains the wear-reducing material and/or with the material of the tool joint itself. In certain aspects of the present invention, a laser beam of a heating apparatus is defocused to reduce the temperature of the heat applied by the laser. In certain preferred aspects, a defocused laser beam, even though operating in a gas envelope, forms no plasma and application temperature achieved are well below that of current prior art welding technologies, as described above. The temperature is, preferably, such that fine particles, e.g., fine carbides (e.g., with a largest dimension of up to about 120 microns) are not melted and remain intact through the laser process. This allows the use of fine particles that are much less aggressive to steel and other metals than the large particles. By achieving close spacing of the fine particles in a resulting cladding (e.g., within 40 microns apart), an extremely wear resistant cladding is produced. In certain methods according to the present invention, dilution of applied material is 5% or less and in certain preferred embodiments this dilution is 2% maximum. Also the chemistry of alloys used in a matrix to hold the wear-reducing material is maintained to a greater extent than with certain prior art processes.

In certain methods according to the present invention, the material applied to a tool joint is in a matrix of materials that has a low coefficient of friction. A laser of a laser application apparatus is, preferably, controlled in a manner so as not to melt the material and to place it into a solid-state solution to form an alloy with the matrix and/or with the material of the tool joint. In certain aspects placing the material in solution with the suspension matrix changes the cladding's coefficient of thermal expansion and causes cracking to occur in the clad deposit. In one aspect according to the present invention the cracking is desirable to provide a stress-relief structure and the amount of cracking in the cladding is controlled by not putting carbides used in the cladding in solution in a random and uncontrolled manner and by engineering a matrix to crack in a pre-determined way to a predetermined extent with cracks having predetermined dimensions [well known in the art (see, e.g., U.S. Pat. Nos. 5,224,559 and 5,350,560 incorporated fully herein for all purposes—which patents neither teach nor suggest laser application of materials as disclosed herein)].

In certain embodiments, an alloy or composite wear-reducing material of predetermined properties and elements is applied to a drill pipe tool joint, utilizing a high-density heat source, such as a laser beam of a laser system. The laser beam provides controlled and concentrated energy, embedding carbides of fine particle size in a metal matrix with minimal degradation of the carbides. Various laser systems are commercially available, including, but not limited to, those that use lasers from the Rofin-Sinar Co. of Hamburg, Germany and from LaserLine GmbH of Koblenz, Germany; and controls from the Siemens Co. or the GE-Finuc Co. Such a laser system can place an amount of wear-reducing material accurately and control the deposit depth, allowing reproducible wear-reducing materials or hardfacings with minimal base metal dilution. The minimal admixture of the base material permits an extremely accurate pre-engineering of the matrix chemistry, allowing customization of the material and tailoring the tool joint to address drilling needs, such as severe abrasion, erosion, and corrosion, as seen, e.g., in open hole drilling conditions. It also permits modification of the deposit to adjust to coefficient of friction needs in metal-to-metal friction, e.g. as encountered in rotation of the drill string within the casing. In certain aspects the deposited material is modified by replacing galling material, e.g., iron and nickel, with non-galling elements, such as e.g., but not limited to, molybdenum, cobalt and chromium and combinations thereof.

In certain preferred embodiments, the admixture of the applied material to the base material is minimized and the resulting bond is a true metallurgical bond. Any suitable wear-reducing material may be applied by methods according to the present invention, including, but not limited to those disclosed in and referred to in U.S. Pat. Nos. 5,051,112; 4,243,727; 5,224,559; and 5,350,560 and those referred to in prior art cited in these patents—all of which are incorporated herein fully for all purposes.

The present invention, in certain aspects, discloses a wire for thermal spraying that includes: 1. copper and/or copper alloy and 2. aluminum and/or aluminum alloy and/or zinc and/or zinc alloy. In one aspect such a wire has an outer sheath of pure aluminum (e.g. 1100 type aluminum) or of aluminum alloy. The outer sheath may, e.g., be made of materials as in Table I. In certain aspects the aluminum alloy contains at least 95% aluminum by weight. The wire, in certain aspects, has a core of pure copper or of copper alloy including, but not limited to copper alloyed with tin, zinc, nickel, manganese, iron and/or silicon. In certain aspects the copper alloy contains at least 80% copper by weight. The core may be made, e.g., of the materials in Table II.

The sheath, in certain aspects, has a thickness ranging between 0.010 inches and 0.020 inches for a wire, e.g., of 1/16 inches in diameter. The sheath for a wire of about 3/16 inches in diameter ranges between 0.010 inches and 0.150 inches thick. By weight the total material of the core, in certain embodiments, ranges between 1% and 60% of the wire's total weight. By weight the sheath, in certain embodiments, ranges between 40% and 99% of the total wire weight. The core may include both copper and copper alloy with copper present in a range of 1% to 60% by weight and copper alloy present in a range of 1% to 60% by weight of the total core weight. The sheath may include both aluminum and/or zinc and aluminum alloy and/or zinc alloy in a range of 40% to 99% by weight of the total sheath weight.

The core may be in powder form or it may itself be a solid wire. In certain embodiments the sheath as described above is made of zinc, zinc alloy, aluminum or aluminum alloy. In other aspects the sheath is made of a combination of any two or more of these materials. The sheath may be made, e.g. of any of the materials in Table III or of a combination of any two or more of them.

In certain embodiments, the wire is made by enclosing the core in the sheath. This can be done by any of the well-known cored wire making processes. Typical sheathed wire or core wire forming processes are disclosed in U.S. Pat. Nos. 3,777,361; 3,648,356; 3,631,586; 3,600,790; 3,436,248; 4,013,211; and the prior art cited in these patents—all of which are incorporated fully here for all purposes.

In other embodiments a wire according to the present invention is made by melting and combining the core material and sheath material to produce a solid combination of the two, in one aspect in the form of rods, and then extruding a wire of suitable diameter from the rods.

In other embodiments, a wire (or strand, filament) or wires of core material is twisted together with a wire or wires of sheath material to form a multi-component wire which has no outer sheath. Alternatively, such a multi-component wire may have an outer sheath of sheath material.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious methods for applying wear-reducing material to wellbore tool joints;

Such methods in which the melting of wear-reducing particles is inhibited or prevented so that the formation of undesired solutions of wear-reducing material and matrix material and/or of wear-reducing material and tool joint material is inhibited or prevented;

Such methods in which undesirable alloying includes none of, only 55% of or less of, or 2% or less of the wear-reducing material;

Such methods in which fine particles of wear-reducing material are not melted and, in other aspects, are closely spaced in a resulting surfacing;

Such methods which make possible the reproducible application of such materials;

Such methods which employ laser application apparatus;

Such methods which produce a true metallurgical bond;

Such methods in which wear-reducing material is applied in the traditional rings around a tool joint's circumference or in which the material is applied in a pattern, including, but not limited to, an intermittent pattern.

New, useful, unique, efficient, nonobvious wires and methods for thermal spraying;

Such wires which have a core of core material and a sheath of sheath material as disclosed herein;

Such wires made of one or more wires of core material and one or more wires of sheath material, with or without a sheath of sheath material; and Such wires used in thermal spraying systems to inhibit marine growth and corrosion.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 7 presents Table I.

FIGS. 8A—8E present Table II.

FIG. 9 presents Table III.

DESCRIPTION OF EMBODIMENTS PREFERRED AT THE TIME OF FILING FOR THIS PATENT

Figure 1A:
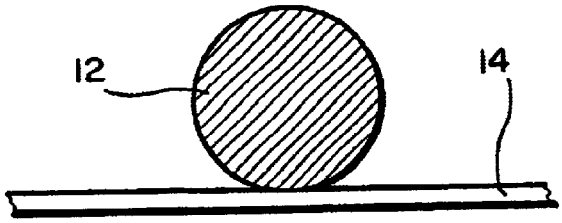
FIG. 1A shows schematically a process for forming a wire according to the present invention as shown in cross-section in FIG. 1B.
Figure 1B:
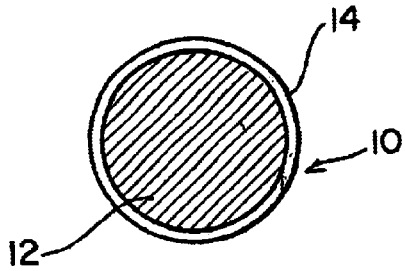

As shown in FIG. 1A, a solid wire 12 of copper, of copper alloy, or of a combination of copper and copper alloy is to be enclosed in an outer cladding or sheath 14 of aluminum, aluminum alloy, or a combination of the two. Any suitable known process for forming the resultant wire 10, FIG. 1B, may be used. In one aspect a known tube mill process is used to form a flat strip into a tube around a core, either powdered or solid.

Figure 2A:
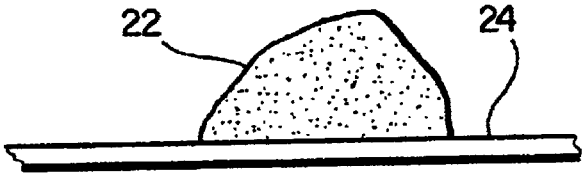
FIG. 2A shows schematically a process for forming a wire according to the present invention as shown in cross-section in FIG. 2B.
Figure 2B:
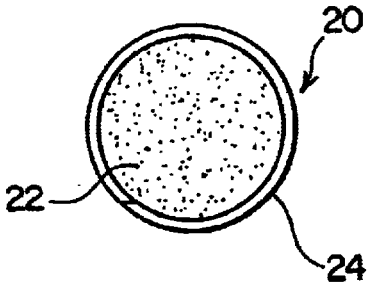

In another aspect as shown in FIGS. 2A and 2B, an amount of powder 22 of copper, copper alloy, or both is used to form the core of a wire 20 that has an outer cladding or sheath 24 of aluminum, aluminum alloy, zinc, and/or zinc alloy. It is within the scope of this invention to feed core material powder and sheath material powder to a spray apparatus instead of feeding wire.

Figure 3:
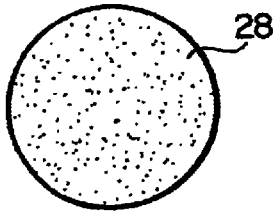
FIG. 3 is a cross-section view of a wire according to the present invention.

FIG. 3 shows a wire 28 according to the present invention which is formed by melting aluminum (and/or aluminum alloy), adding and melting copper (and/or copper alloy) to the aluminum melt, and forming rods which are then used to extrude the wire 28. Any suitable known wire forming or extrusion system may be used.

Figure 4:
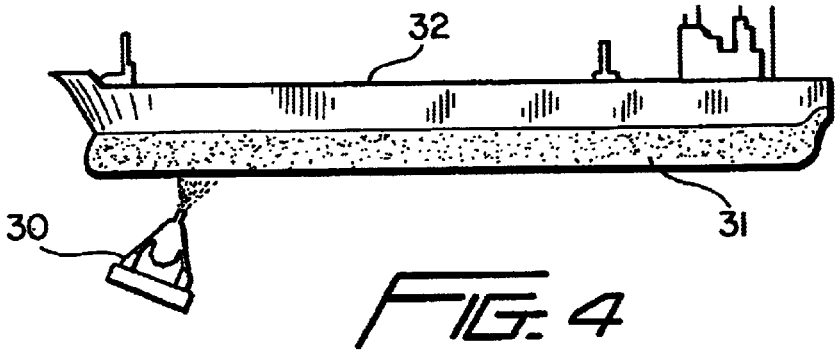
FIG. 4 shows schematically a process for applying a coating to a marine vessel with wire according to the present invention.

FIG. 4 shows schematically a method for applying a coating to an object using a wire according to the present invention. A thermal spray system 30 employing one, two, or more wires according to the present invention sprays a coating onto the hull 31 of a vessel 32. Preferably such a coating according to the present invention will range between 0.005 inches and 0.125 inches thick, although it is within the scope of this invention to employ coatings that are thinner or thicker. In one aspect a known twin wire arc spray system is used. Any object or item, including, but not limited to, boats, hulls, piers, docks, structures, buoys, cables, anchors, and any object or item subject to damage by marine growth may be coated according to the present invention.

When used as a coating for items or objects in a marine environment according to the present invention, the aluminum and/or aluminum alloy and/or zinc and/or zinc alloy in the coating acts as a cathode to produce a cathodic effect that inhibits corrosion. The copper or copper alloy acts as a biocide for marine growth such as barnacles, algae, and coral.

Figure 5A:
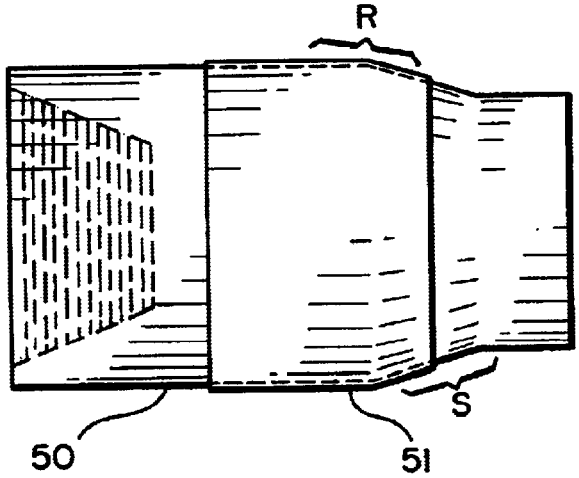
FIG. 5A is a side view.
Figure 5B:
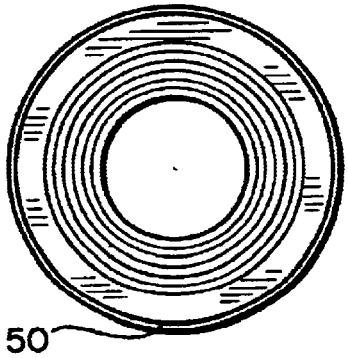
FIG. 5B is an end view of a tool joint according to the present invention.

FIGS. 5A and 5B show a tool joint 50 with a coating 51 (which may be any coating according to the present invention) according to the present invention. It is within the scope of the present invention to coat the entire exterior surface of the tool joint 50 (or any tool joint shown or described herein) or only a portion thereof. The entire outer surface of the tool joint may be coated. In one particular aspect only the area "R" or "S" is coated according to the present invention. Alternatively, although not a legal equivalent of the spraying described herein, the tool joint 50 may have wear-reducing material applied to it or be "hardfaced" with the patterns or designs disclosed herein employing any suitable known hardfacing process or by using methods according to the present invention. A drill pipe tool joint is the mechanism used to join the drill string together. One end is a male fitting called in the trade a "pin." The other is a female fitting called the "box" into which the pin screws. The joint is larger in diameter than the tube itself. When the two parts join together by threads, they form an assembly that must have greater tensile and fatigue strength than the tube body. In use the tool joint rubs against the drilled wall of a hole or against steel casing in the hole.

According to certain aspects of the present invention extremely fine carbides in a matrix of materials that has a low coefficient of friction are applied by a laser system whose laser apparatus is controlled in a manner so as not to melt the carbides and place them into a solid-state solution so as not to form an alloy with the matrix. Placing the carbides in solution with the suspension matrix changes the cladding's coefficient of thermal expansion and causes cracking to occur in the clad deposit. In one aspect according to the present invention the amount of cracking in the cladding is limited to keep foreign substances from penetrating the base metal.

In one aspect the carbides used are of any of the refractory carbide groups and combinations of the carbides, which become complex carbides, including but not limited to, titanium, zirconium, hafnium, vanadium, niobium, tantalum, chromium, molybdenum, and tungsten and the combinations of any or all of these. In one aspect the general geometric shape of the particles is spherical, but potato-shaped and angular-shaped can be used. The carbides may be held together with a binder such as cobalt, nickel, iron, or chromium, or can be used without a binder. The matrix that holds the carbides in place is, in one aspect, a good wear resistant material itself. It may be a cobalt-based material, such as Stellite, or a nickel based material, such as Colmonoy, or may be an iron based material, such as a high chromium iron. In one aspect the bands of the cladding extend for 4–6 inches along the axis of the pipe on the box and 3–5 inches along the pin.

Figure 6A:
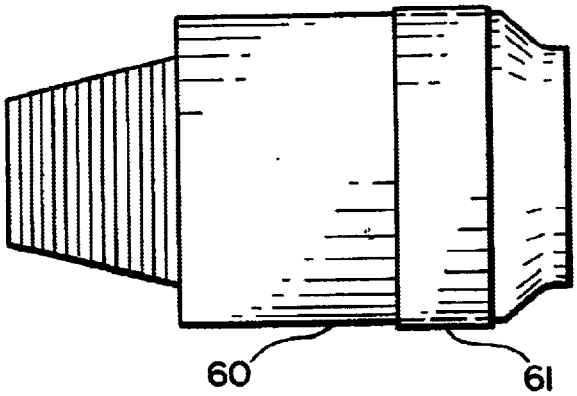
FIG. 6A is a side view.
Figure 6B:
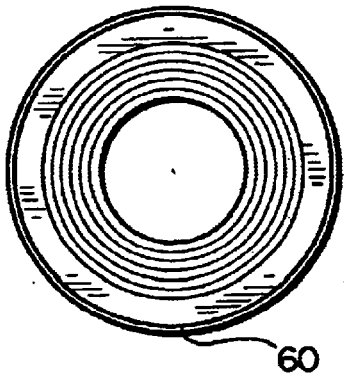
FIG. 6B is an end view of a tool joint according to the present invention.
Figure 10:
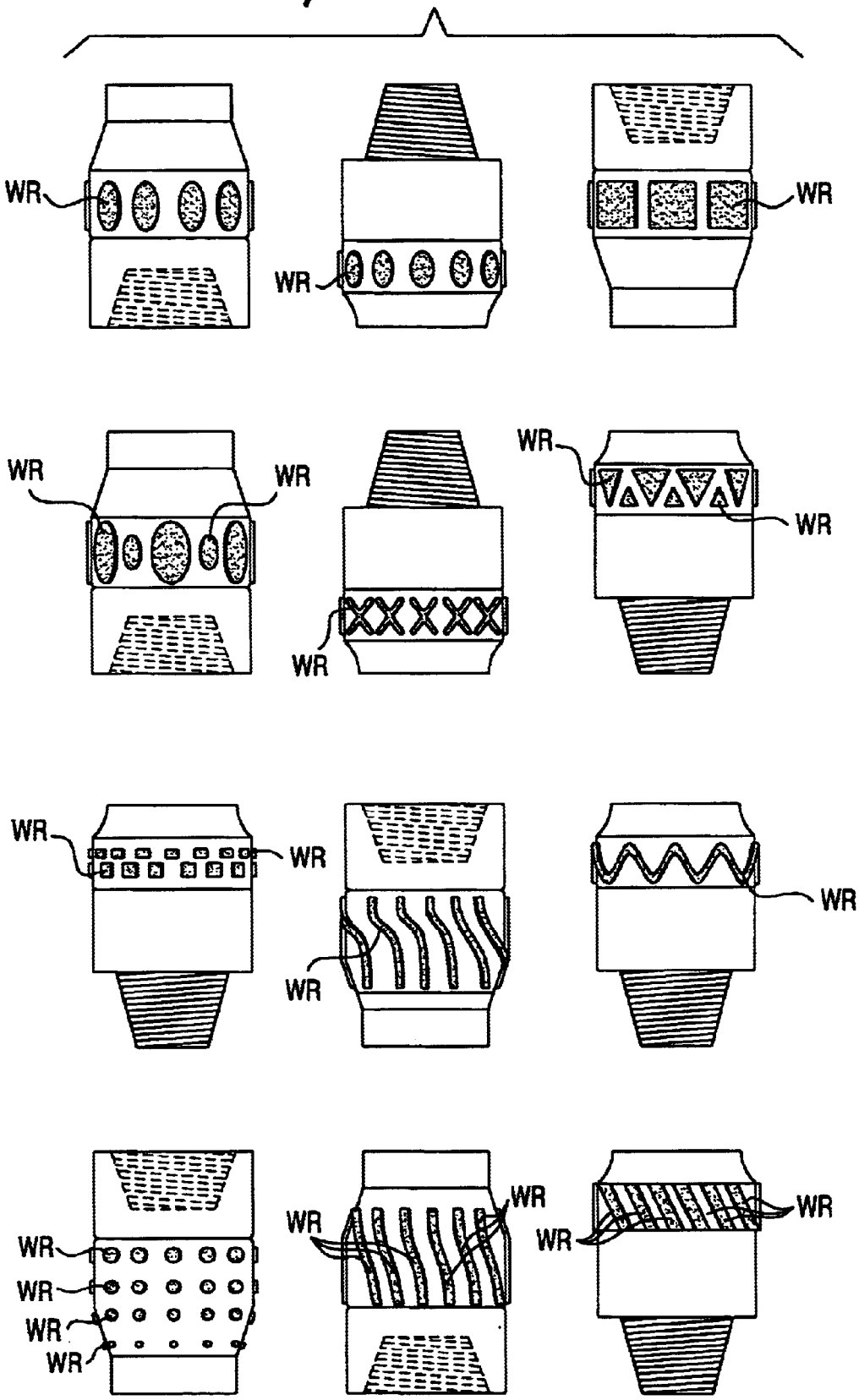
FIG. 10 shows a variety of patterns, designs and shapes for wear-reducing material applied on tool joints according to the present invention.

FIGS. 6A and 6B show a tool joint 60 with a coating 61 according to the present invention. It is within the scope of the present invention to coat the entire exterior surface of the tool joint 60 or only a portion thereof.

Laser methods of application according to certain embodiments of the present invention apply wear-reducing material (e.g., carbides and hardfacing) without undesirable levels of alloying with matrix material and/or with metal from a tool joint and, preferably, yield a deposit with less than 5% of such alloying (dilution) and, in certain preferred embodiments, 2% or less of such alloying (dilution). Such methods permit the control of repetitive applications within ±0.020 inch thickness and ±0.030 inch placement and produce a metallurgical bond between the base metal of the tool joint and the wear-reducing material. Also, such methods allow base material to retain its integrity, as a result of which the material applied with the laser more accurately retains its engineered properties. Thus coatings according to certain embodiments of the present invention are engineered to fit a specific need, e.g., but not limited to, maximum abrasive wear resistance, maximum erosive wear resistance, and modified coefficient of friction as needed to achieve desired end results for tool joint service.

The laser application apparatus used in methods according to certain embodiments of the present invention permits the use of alloys and elements previously difficult-to-impossible to apply—including the iron-dominant, nickel-dominant, and cobalt-dominant families of materials. In certain aspects, the alloying elements for the three dominant elements (iron, nickel, and cobalt) in a 1.5 range of 5–35% are chromium, manganese, molybdenum, vanadium, and tungsten. The alloying elements in a dominant element range of 0–5% are boron, carbon, aluminum, titanium, zirconium, tantalum, sulfur, silicon, phosphorus, bismuth, cerium, praseodymium, neodymium, promethium, samarium, europium, gadolinium, terbium, dysprosium, holmium, erbium, thulium, ytterbium, and lutetium. Methods according to the present invention using laser application apparatus also permit application of composite coatings comprised of the carbides, borides, silicides, and nitrides as hard particles and held in place by the aforementioned alloys. These refractory materials include, but are not limited to, the following:

carbides: titanium carbide, zirconium carbide, hafnium carbide, vanadium carbide, niobium carbide, tantalum carbide, chromium carbide, molybdenum carbide, and tungsten carbide.

nitrides: titanium nitride, zirconium nitride, hafnium nitride, vanadium nitride, niobium nitride, tantalum nitride, chromium nitride, molybdenum nitride, and tungsten nitride.

borides: titanium boride, zirconium boride, hafnium boride, vanadium boride, niobium boride, tantalum boride, chromium boride, molybdenum boride, and tungsten boride.

silicides: titanium silicide, zirconium silicide, vanadium silicide, niobium suicides, tantalum silicide, chromium silicide molybdenum, and tungsten silicide.

Using a laser apparatus in certain methods according to the present invention with a laser as heat source, wear-reducing material is applied to the outer diameter of the box and pin and, due to the precision afforded by the laser uniform coating thickness is achieved on both box and pin, and thus the tool joint wears uniformly down hole.

In certain prior art hardfacing methods material has traditionally been welded on tool joints in rings around their circumference. Laser-applied materials according to the present invention may be applied insuch rings, but it is also within the scope of the present invention to apply material in any shapes, lines, designs and/or patterns, for example, a series of lines, shapes, spots, "X's," or diagonal strips or lines to enhance control of down hole hydraulics. FIG. 7 shows a variety of such patterns, etc. with locations of wear-reducing material indicated by "WR." By providing wear-reducing material in separate, defined spaced-apart areas, fluid flow in a wellbore annulus past a tool joint is enhanced, i.e., flow between deposit areas is facilitated.

In certain aspects, in a method according to the present invention a tool joint's exterior surface may or may not have a groove to receive the wear-reducing material. In one aspect such a tool joint is made of material that is of low alloy composition e.g. but not limited to commercially available A1S1 4137, and heating prior to welding is preferable to reduce the need for a rapid quench (in such steel a rapid quench can elevate hardness above a desired level) and reduce the hardness of the heat affected zone. Preheating modifies the quench level and yields a more nearly normal hardness. The material quenches, in certain aspects, rapidly enough so that it transitions to martensite. In certain aspects a tool joint is, according to the present invention, quenched and tempered to a Brinell hardness between 284 and 342. Application of material on a non-preheated joint can result in a Brinell hardness that is too high, e.g., in excess of 400, which can cause crack propagation into a tool joint's base material. Using a preheat can reduce or eliminate such unwanted crack propagation.

Preferably an engineering schedule is organized which for such a method ("hard banding") includes rate of powder delivery, laser intensity, speed of travel of tool joint under a laser, number of passes and number of layers, and application layout. With certain laser systems, following such pre-engineering, actual application is automatically controlled when the raw tool joint is placed in position. The process is completed with controlled cooling to reduce stresses.

In one particular method according to the present invention an engineering schedule is prepared for a tool joint to be treated. For a typical tool joint made of A1S1 4137, 20 inches long, with a wall thickness of 1–5 inches, the "powder" delivery rate is 110 grams per minute; the "powder" or cladding material is 65% by weight spherical cast tungsten carbide with a size between 80 and 250 mesh and 35% by weight matrix material which is nickel-chrome-boron silicon with a hardness of 40RC; the laser intensity is set at 6 kilowatts; the speed of travel is 45" per minute with an overlap between passes of 0.110", yielding a deposit of approximately 0.070" thick and a deposit on the tool joint that is 3.75" long. With this pre-engineering, actual application is automatically controlled when the raw tool joint is placed in position. The resulting applied material is of low alloy composition, and in this particular embodiment the tool joint is preheated (e.g. to 850 degrees F.) in order to reduce the rapid quench and reduce the hardness of the heat affected zone. The clean (preferably) preheated tool joint (which may or may not have a groove to receive the cladding material) is placed into a fixture manipulator that rotates the tool joint about its axis under the laser beam. The fixture may also, as desired, translate the tool joint parallel with its axis. The powder (the cladding material and/or hardfacing alloy) may be delivered either by coaxial feed or side delivery (both well known in the prior art). Coaxial feed is a feed that the powder flows into a laser light stream above the work piece. The powder is heated to slightly above its molten temperature (e.g. to 2150 degrees F.) as it is carried downward by gravity. The laser, in addition, heats the tool joint base material to a near molten state in preparation to receive the powder, now heated to a molten state and application occurs. In a the side delivery method, the powder is injected into the laser light beam in close proximity to the surface of the tool joint. The light melts the powder and also brings the tool joint surface to application temperature. Preferably, in both cases an inert gas is used to shield the heated materials to inhibit or prevent oxidation. In one aspect, helium is used.

One laser machine used in a method according to the present invention is a Rofin-Sinar model 860, CO2 laser. In one particular aspect, the machine is de-focused so that no plasma is formed, e.g., in one aspect to an oval spot of approximately 6 millimeters×8 millimeters. By contrast, a focused spot would be 0.05 mm by 0.05 mm which would cause a plasma to form with its corresponding undesirable high temperature. Using 6500 watts of power output and 60–70 grams of powder per minute, the machine deposits material 1.5 millimeters thick in an oval shape (e.g. as in FIG. 7) at 1500–2000 millimeters per minute. Continuous passes overlap the previous pass by approximately two-thirds the width of the pass.

One present industry accepted standard for width of hard facing is 3¾" around the circumference of a box tool joint with ¾" of the material deposited in a groove (about 0.080 inches deep) so that it becomes flush with a rig's elevator's shoulder, so that the tool joint does not hang up when the pipe is handled with the elevator. A width of 3" of material is applied on the outer diameter, either in a groove so that it is flush, or "proud", i.e. projecting above the surface of the tool joint up to 0.250 inches. The pin end of the tool joint may or may not be clad or hardfaced; but if desired, and/or when requirements dictate, a band of material is applied to the outer diameter which, in one particular aspect, is about 2" wide. Patterns designed with spaced-apart areas of deposited wear-reducing material to enhance hydraulic properties are easily achieved with a computer-programmed laser. The tool joint may be cooled to ambient temperature by letting it sit until cooled or, according to the present invention, cooling is controlled to reduce stresses. Two particular methods for cooling are burying the tool joint in vermiculite, and conveying the tool joint through a cooling apparatus such as a cooling oven.

The present invention, therefore, provides in certain, but not necessarily all embodiments, a method for thermal spraying, the method including spraying a coating onto an object with a thermal spray system, the thermal spray system using wire to produce the coating, the wire comprising sheath material and core material, the core material acting as a biocide for marine growth and the sheath material acting as a cathode. Such a method may have one, some (in any possible combination) or all of the following: wherein the sheath material comprises 35% to 65% of the wire by weight, and the core material comprises 35% to 65% of the wire by weight; wherein the coating is between 0.010 inches and 0.020 inches thick; wherein the sheath material is from the group consisting of aluminum, aluminum alloy, zinc, and zinc alloy, and the core material is from the group consisting of copper and copper alloy; and/or wherein the object is the hull of a vessel.

The present invention, therefore, provides in certain, but not necessarily all embodiments, a wire for use in thermal spraying, the wire including aluminum material, and copper material. Such a method may have one, some (in any possible combination) or all of the following: wherein the aluminum material is aluminum; wherein the aluminum material is an aluminum alloy; wherein the aluminum material is a combination of aluminum and aluminum alloy; wherein the copper material is copper; wherein the copper material is a copper alloy; wherein the copper material is a combination of copper and copper alloy; wherein the aluminum material is 35% to 65% of the wire by weight, and the copper material is 35% to 65% of the wire by weight; the aluminum material is about 50% of the wire by weight, and the copper material is about 50% of the wire by weight; wherein the copper material is enclosed within the aluminum material; and/or wherein the copper material and aluminum material are intermingled together.

The present invention, therefore, provides in certain, but not necessarily all embodiments, a wire for use in thermal spraying, the wire having core material and sheath material, wherein the sheath material is from the group consisting of aluminum, aluminum alloy, zinc, and zinc alloy, and the core material is from the group consisting of copper and copper alloy.

The present invention, therefore, provides in certain, but not necessarily all embodiments, an object coated with a thermally sprayed-on coating, the spraying done by spraying a coating onto an object with a thermal spray system, the thermal spray system using source material to produce the coating, the source material comprising material acting as a cathode and material acting as a biocide. Such a method may have one, some (in any possible combination) or all of the following: wherein the source material is wire that includes sheath material that is 35% to 65% of the wire by weight, and the core material that is 35% to 65% of the wire by weight; and/or wherein the object is the hull of a vessel.

The present invention, therefore, provides in certain, but not necessarily all embodiments, a method for thermal spraying, the method including spraying a coating onto an object with a thermal spray system, the thermal spray system using powder to produce the coating, the powder including first material and second material, the second material acting as a biocide for marine growth and the first material acting as a cathode; and such a method wherein the first material is from the group consisting of aluminum, aluminum alloy, zinc, and zinc alloy, and the second material is from the group consisting of copper and copper alloy.

Figure 11:
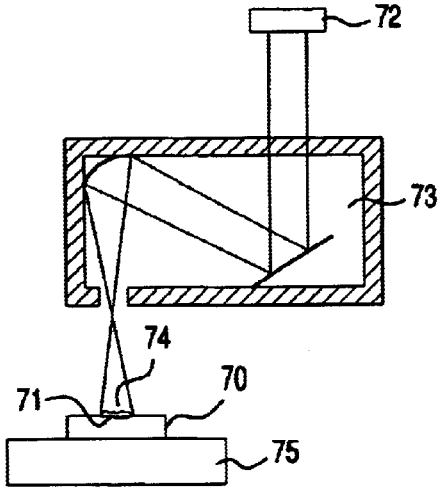
FIG. 11 shows schematically apparatus useful in methods according to the present invention.

FIG. 11 shows schematically a tool joint 70 being treated with wear-reducing material 71 by a method according to the present invention (including, but not limited to, by any method described above for applying wear-reducing material to a tool joint) using a laser apparatus 72 with optics apparatus 73 producing a defocused laser beam 74. A typical workpiece manipulator 75 holds, manipulates, and rotates the tool joint 70 beneath the laser apparatus 72.

Figure 12:
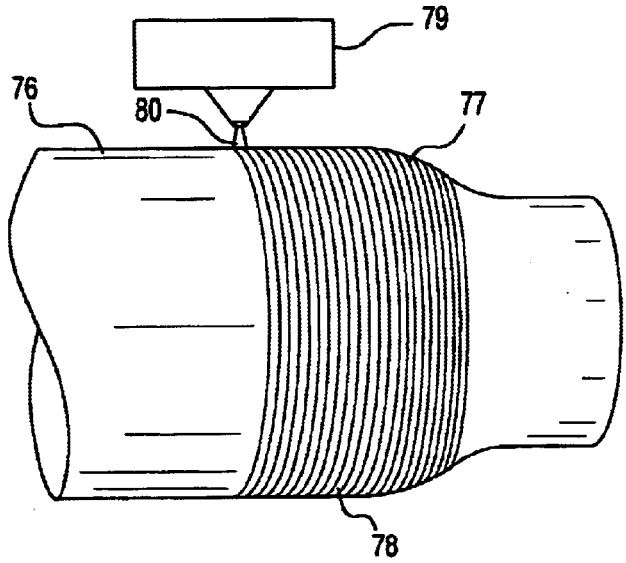
FIG. 12 shows a tool joint pin end being treated according to the present invention.
Figure 13:
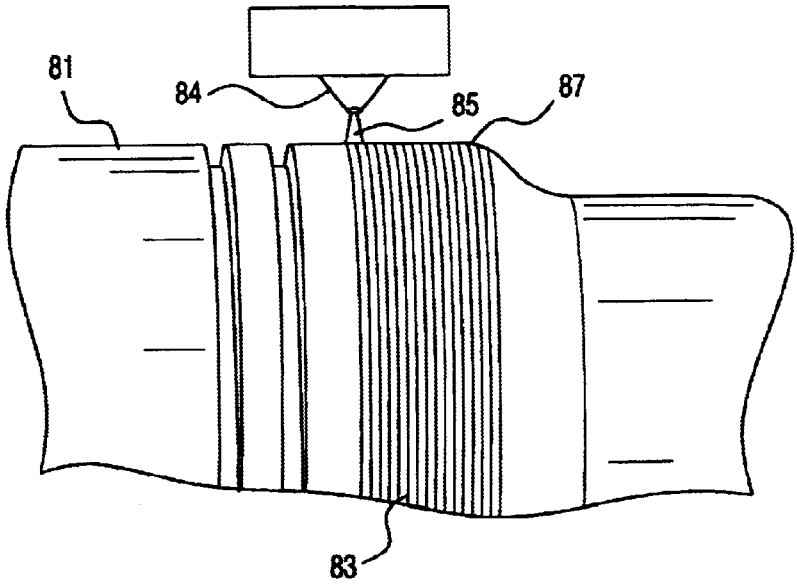
FIG. 13 shows partially a tool joint box end being treated according to the present invention.

As shown in FIG. 12, a tool joint 76 has a pin end 77 to which wear-reducing material 78 is applied by a laser apparatus 79 with a defocused beam 80. As shown in FIG. 13, a tool joint 81 has a box end 82 (shown partially) to which wear-reducing material 83 is applied by a laser apparatus 84 with a defocused beam 85. Any method and/or apparatus according to the present invention can be used for the applications of FIGS. 12 and 13.

The present invention, therefore, provides in certain, but not necessarily all embodiments, a tool joint as disclosed herein and methods for treating it with wear-reducing material; such a tool joint in one aspect having wear-reducing material applied thereto using a laser apparatus with a laser beam that is not optimally focused, i.e., a laser beam which is intentionally defocused to a desired extent so that a desired temperature (e.g., the melting temperature of the tool joint base material or a temperature only slightly higher than this temperature) is not exceeded.

The present invention, therefore, provides in certain, but not necessarily all embodiments, a method for applying wear reducing material to a tool joint useful in a wellbore in drilling operations, the method including positioning the tool joint adjacent laser beam apparatus, delivering wear-reducing material to a location on the tool joint to which the wear-reducing material is to be applied, the wear-reducing material having a melting temperature, and heating the wear-reducing material with the laser beam apparatus to a temperature not exceeding the melting temperature of the wear-reducing material thereby welding the wear-reducing material to the tool joint.

The present invention, therefore, provides in certain, but not necessarily all embodiments, a method for applying wear reducing material to a tool joint useful in a wellbore in drilling operations, the method including positioning the tool joint adjacent laser beam apparatus, delivering wear-reducing material to a location on the tool joint to which the wear-reducing material is to be applied, and heating the wear-reducing material with a defoucsed laser beam from the laser beam apparatus thereby welding the wear-reducing material to the tool joint.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A method for applying wear reducing material to a tool joint useful in a wellbore in drilling operations, the method comprising positioning the tool joint adjacent laser beam apparatus, delivering wear-reducing material to a location on the tool joint to which the wear-reducing material is to be applied, the wear-reducing material having a melting temperature, heating the wear-reducing material with the laser beam apparatus to a temperature not exceeding the melting temperature of the wear-reducing material thereby welding the wear-reducing material to the tool joint, wherein the laser beam apparatus is defocused so that no plasma is formed adjacent the tool joint, wherein the wear-reducing material is applied with a substantially uniform thickness to the tool joint, wherein a metallurgical bond is formed between the wear-reducing material and the tool joint, wherein the wear-reducing material includes carbides, wherein the carbides are in a matrix of wear resistant material, and wherein the tool joint is made of base metal and there is less than 5% dilution of the base metal by the applied wear-reducing material.

2. A method for applying wear reducing material to a tool joint useful in a wellbore in drilling operations, the method comprising positioning the tool joint adjacent laser beam apparatus, delivering wear-reducing material to a location on the tool joint to which the wear-reducing material is to be applied, the wear-reducing material having a melting temperature, heating the wear-reducing material with the laser beam apparatus to a temperature not exceeding the melting temperature of the wear-reducing material thereby welding the wear-reducing material to the tool joint, and wherein the tool joint is made of base metal and there is less than 5% dilution of the base metal by the applied wear-reducing material.

3. The method of claim 2 wherein the tool joint is made of base metal and there is less than 2% dilution of the base metal by the applied wear-reducing material.

4. The method of claim 2 wherein the wear-reducing material is heated with a laser beam that is defocused so that the melting temperature of the wear-reducing material is not exceeded.

5. The method of claim 2 wherein the tool joint is made of tool joint material and the wear-reducing material is heated with a laser beam that is defocused so that the tool joint material is not melted.

6. The method of claim 2 wherein the wear-reducing material is applied in a pattern of intermittent spaced-apart areas of wear-reducing material.

7. The method of claim 6 wherein the intermittent spaced-apart areas of wear reducing material provide fluid flow paths therebetween for enhancing fluid flow past the tool joint when it is within a wellbore.

8. The method of claim 2 further comprising applying the wear-reducing material to the tool joint so that cracks are formed in the wear-reducing material for reducing stress in the applied wear-reducing material.

9. The method of claim 2 wherein the laser beam apparatus is defocused so that no plasma is formed adjacent the tool joint.

10. The method of claim 2 wherein the wear-reducing material is applied with a substantially uniform thickness to the tool joint.

11. The method of claim 2 wherein the thickness varies between ±0.020 inches.

12. The method of claim 2 wherein a metallurgical bond is formed between the wear-reducing material and the tool joint.

13. The method of claim 2 wherein the wear-reducing material includes carbides.

14. The method of claim 4 wherein the carbides are in a matrix of wear resistant material.

15. The method of claim 2 wherein the wear-reducing material is combined with friction reducing material.

16. The method of claim 2 wherein the wear-reducing material is from the group consisting of carbides, borides, suicides, and nitrides.

17. The method of claim 2 wherein the wear-reducing material is alloyed with an alloying element from the group consisting of chromium, manganese, molybdenum, vanadium, boron, carbon, aluminum, titanium, zirconium, tantalum, sulfur, silicon, phosphorus, bismuth, cerium, praseodymium, neodymium, promethium, samarium, europium, gadolinium, terbium, dysprosium, holmium, erbium, thulium, ytterbium, and lutetium.

18. A method for applying wear reducing material to a tool joint useful in a wellbore in drilling operations, the tool joint made of base metal, the method comprising positioning the tool joint adjacent laser beam apparatus, delivering wear-reducing material to a location on the tool joint to which the wear-reducing material is to be applied, heating the wear-reducing material with a defocused laser beam of the laser beam apparatus thereby welding the wear-reducing material to the tool joint, and wherein there is less than 2% dilution of the tool joint's base metal by the applied wear reducing material.

19. A method for applying wear reducing material to a tool joint useful in a wellbore in drilling operations, the method comprising positioning the tool joint adjacent laser beam apparatus, delivering wear-reducing material to a location on the tool joint to which the wear-reducing material is to be applied, the wear-reducing material having a melting temperature, heating the wear-reducing material with the laser beam apparatus to a temperature not exceeding the melting temperature of the wear-reducing material thereby welding the wear-reducing material to the tool joint, and wherein the wear-reducing material is applied in a pattern of intermittent spaced-apart areas of wear-reducing material.

20. The method of claim 19 wherein the intermittent spaced-apart areas of wear reducing material provide fluid flow paths therebetween for enhancing fluid flow past the tool joint when it is within a wellbore.

21. A method for applying wear reducing material to a tool joint useful in a wellbore in drilling operations, the method comprising positioning the tool joint adjacent laser beam apparatus, delivering wear-reducing material to a location on the tool joint to which the wear-reducing material is to be applied, the wear-reducing material having a melting temperature, heating the wear-reducing material with the laser beam apparatus to a temperature not exceeding the melting temperature of the wear-reducing material thereby welding the wear-reducing material to the tool joint, and applying the wear-reducing material to the tool joint so that cracks are formed in the wear-reducing material for reducing stress in the applied wear-reducing material.

22. A method for applying wear reducing material to a tool joint useful in a wellbore in drilling operations, the method comprising positioning the tool joint adjacent laser beam apparatus, delivering wear-reducing material to a location on the tool joint to which the wear-reducing material is to be applied, the wear-reducing material having a melting temperature, heating the wear-reducing material with the laser beam apparatus to a temperature not exceeding the melting temperature of the wear-reducing material thereby welding the wear-reducing material to the tool joint, and wherein the wear-reducing material is applied with a substantially uniform thickness to the tool joint and said substantially uniform thickness varies between ±0.020 inches.

* * * * *